US008820000B2

(12) United States Patent
Pedretti et al.

(10) Patent No.: US 8,820,000 B2
(45) Date of Patent: Sep. 2, 2014

(54) PNEUMATIC SUPPORT

(75) Inventors: Mauro Pedretti, Biasca (CH); Rolf Luchsinger, Seegräben (CH)

(73) Assignee: Prospective Concepts AG, Dietikon (CH)

( * ) Notice: Subject to any disclaimer, the term of this patent is extended or adjusted under 35 U.S.C. 154(b) by 269 days.

(21) Appl. No.: 13/109,573

(22) Filed: May 17, 2011

(65) Prior Publication Data

US 2011/0252716 A1 Oct. 20, 2011

Related U.S. Application Data

(63) Continuation-in-part of application No. 10/562,100, filed as application No. PCT/CH2004/000384 on Jun. 24, 2004, now abandoned.

(30) Foreign Application Priority Data

Jul. 18, 2003 (CH) ..... 1259/03

(51) Int. Cl.

| | |
|---|---|
| ***E04B 1/36*** | (2006.01) |
| ***E04B 1/02*** | (2006.01) |
| ***E04H 15/20*** | (2006.01) |
| ***E04H 15/34*** | (2006.01) |
| *E04C 3/02* | (2006.01) |

(52) U.S. Cl.

CPC ..... *E04H 15/20* (2013.01); *E04H 15/34* (2013.01); *E04C 3/02* (2013.01)

USPC ..... 52/2.13; 52/2.22; 52/2.26

(58) Field of Classification Search

CPC ..... E04B 1/36; E04B 1/02; E04H 15/34; E04H 15/20; E04H 15/425; E04H 15/42; E04H 15/44; E04C 3/02; E04C 1/34

USPC ..... 52/2.22, 2.23, 2.18, 2.24, 223.8; 14/73.5, 74.5; 248/560; 60/512, 515, 60/508

See application file for complete search history.

(56) References Cited

U.S. PATENT DOCUMENTS

| | | | | |
|---|---|---|---|---|
| 2,743,510 | A | 5/1956 | Mauney et al. | |
| 3,300,910 | A | 1/1967 | Peter | |
| 3,364,488 | A | 1/1968 | Perenic et al. | |
| 3,432,609 | A | 3/1969 | Brion, Jr. et al. | |
| 3,830,519 | A * | 8/1974 | Lewis | 280/733 |

(Continued)

FOREIGN PATENT DOCUMENTS

| | | |
|---|---|---|
| DE | 101 42 108 A1 | 5/2003 |
| EP | 1752600 A1 | 2/2007 |

(Continued)

*Primary Examiner* — Phi A
(74) *Attorney, Agent, or Firm* — Winstead PC

(57) ABSTRACT

A pneumatic support comprises a long hollow body, tapering towards the ends and two pressure/tension elements. The hollow body is embodied by a sleeve of gas-tight, flexible, non-stretch material. Said sleeve can be formed from two layers, an external non-stretch, flexible sleeve and an inner gas-tight elastic bladder. The hollow body can be pressurised with compressed gas by means of a valve. The both pressure/tension elements lie along diametrically opposed surface lines of the hollow body on the same and are partly or completely frictionally connected to the hollow body along said surface lines. The ends of the pressure/tension elements are frictionally connected to each other.

16 Claims, 5 Drawing Sheets

(56) References Cited

U.S. PATENT DOCUMENTS

| | | | | | |
|---|---|---|---|---|---|
| 3,894,307 | A | | 7/1975 | Delamare | |
| 3,973,363 | A | | 8/1976 | LaPorte et al. | |
| 4,065,889 | A | * | 1/1978 | Fraioli | 52/2.23 |
| 4,970,831 | A | | 11/1990 | Rota | |
| 5,677,023 | A | * | 10/1997 | Brown | 428/36.6 |
| 5,735,083 | A | * | 4/1998 | Brown et al. | 52/2.13 |
| 6,860,218 | B2 | * | 3/2005 | Eagles et al. | 114/256 |
| 2002/0157322 | A1 | * | 10/2002 | Pedretti | 52/2.13 |

FOREIGN PATENT DOCUMENTS

| | | | |
|---|---|---|---|
| JP | 05018147 | A | 1/1993 |
| JP | 7173898 | | 7/1995 |
| JP | 8333922 | A | 12/1996 |
| JP | 9209612 | A | 8/1997 |
| JP | 10061259 | A | 3/1998 |
| JP | 11256880 | A | 9/1999 |
| JP | 2004225276 | A | 8/2004 |
| JP | 2005172180 | A | 6/2005 |
| JP | 2006063623 | A | 3/2006 |
| WO | WO-01/73245 | A1 | 10/2001 |
| WO | WO-03/016634 | | 2/2003 |
| WO | WO-2004001163 | A1 | 12/2003 |
| WO | WO-2004/083569 | A1 | 9/2004 |
| WO | WO-2005/021898 | A1 | 3/2005 |
| WO | WO-2005042880 | A1 | 5/2005 |
| WO | WO-2006099764 | A1 | 9/2006 |
| WO | WO-2007147270 | A1 | 12/2007 |

* cited by examiner a)

b)

c)

PNEUMATIC SUPPORT

CROSS-REFERENCE TO RELATED APPLICATIONS

The present application is a continuation-in-part of U.S. patent application Ser. No. 10/562,100 now abandoned. U.S. patent application Ser. No. 10/562,100 is a national-stage application of International Patent Application No. PCT/CH04/000384. International Patent Application No. PCT/CH04/000384 was filed on Jun. 24, 2004. International Patent Application No. PCT/CH04/000384 claims priority from Swiss Patent Application No. 01259/03, which was filed on Jul. 18, 2003. U.S. patent application Ser. No. 10/562,100, International Patent Application No. PCT/CH04/000384, and Swiss Patent Application No. 01259/03 are each incorporated herein by reference.

BACKGROUND

Pneumatic supports in the form of inflatable hollow bodies are known in several variations, for example, from U.S. Pat. No. 3,894,307 (D1) and WO 01/73245 (D2) of the same applicant as the present application. If such a support is subjected to a transversal load, the primary objective consists of absorbing the occurring tensile forces and shearing forces without causing the support to buckle.

In D2, the axial compressive forces are absorbed by a compression member while the axial tensile forces are absorbed by two tension elements that are helicoidally wound around the hollow body and fixed on the ends of the compression member. The pneumatic portion of the structural elements described in this publication has the function of stabilizing the compression members against buckling.

In D1, several hollow bodies are combined in a parallel fashion so as to form a bridge. In this case, the tensile forces are absorbed by a flexible cover that encompasses all hollow bodies, and the compressive forces are absorbed by the bridge plate that is composed of strung-together elements. The elements are laterally fixed on the cover that encompasses the hollow bodies and thusly secured against buckling.

D2 is the document most closely related to the present invention. The pneumatic structural element disclosed in D2 contains at least two tension elements that are relatively long in comparison with the length of the structural element due to their helicoidal arrangement around the hollow body. Under a load, this leads to a more significant deflection than in instances, in which shorter tension elements are used. When such an element is used as a support, the nodes for absorbing the bearing forces which lie on top of the structural element rather than on the outermost end thereof require complicated bearing constructions. In D1, the tension element consists of a large-surface cover that is only able to absorb tensile forces to a limited degree and can only be stretched with a significant technical expenditure.

The invention is based on the objective of developing pneumatic supports with tension and compression members that have a high flexural strength, can be manufactured in a simple and cost-efficient fashion and easily assembled into complex structural components and structures, for example, roofs and bridges, wherein these structural components and structures can also be erected very quickly and easily connected to conventional constructions.

With respect to its essential characteristics, the solution to this objective is disclosed in the characterizing portion of claim 1, wherein other advantageous embodiments are disclosed in the succeeding claims.

BRIEF DESCRIPTION OF THE DRAWINGS

The object of the invention is described in greater detail below with reference to several embodiments that are illustrated in the enclosed figures. The figures show.

DETAILED DESCRIPTION

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art.

Figure 1:
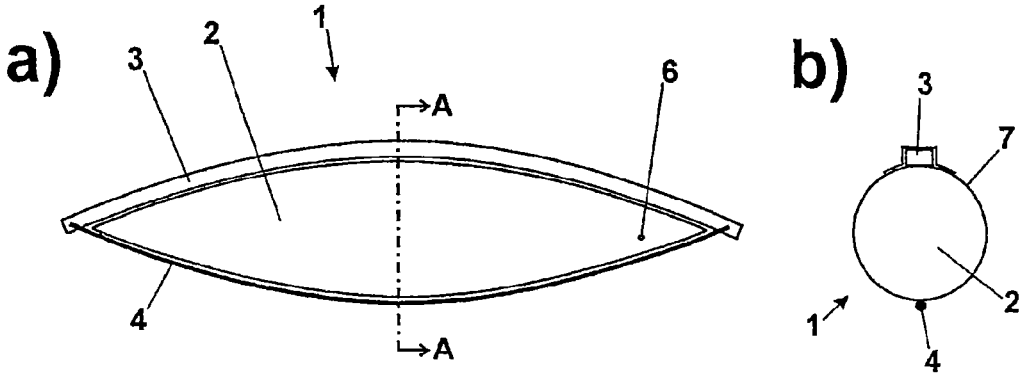
FIGS. 1*a, b*, a schematic side view of and a cross section through a first embodiment of a pneumatic support.

FIG. 1 shows a schematic representation of a first embodiment of the object of the invention. A support 1 consists of an elongated hollow body 2 that is tapered toward the ends, a compression bar 3 and a tension element 4. The hollow body 2 is formed by a cover 7 of a gas-tight material that is flexible, but has limited stretchability. Since it is difficult to combine these properties in one material, the hollow body 2 is advantageously composed of a flexible outer cover 7 of limited stretchability and an elastic, gas-tight inner bladder. The hollow body 2 can be pressurized with compressed gas by means of a valve 6. The compression bar 3 and the tension element 4 adjoin the hollow body 2 along diametrically opposite surface lines thereof. The compression bar 3 is connected to the hollow body 2 along this surface line with suitable means. This may be realized, for example, with a welt-type connection, pockets or several belts that encompass the hollow body 2. The ends of the tension element 4 are positively fixed to the ends of the compression bar 3. This first embodiment of a pneumatic support 1 is suitable for applications, in which compressive forces act upon the support 1 in only one direction. This applies, for example, to a bridge support that is subjected to a load consisting of the own weight of the bridge and the imposed load. The compression bar 3 and the tension element 4 lie in the active plane of the load vector that acts upon the compression bar 3 and points in the direction of the tension element 4. The hollow body 2 prevents the compression bar 3 from buckling such that the material of the compression bar 3 can be stressed up to the yield point. This yield point lies at a significantly higher force than the buckling load of a bar. In addition, the hollow body 2 spatially separates the compression bar 3 and the tension element 4 from one another. Such a construction is characterized in a low consumption of materials, a low weight and a high load bearing capacity. FIG. 1*a* shows a side view, and FIG. 1*b* shows a section along the line AA.

Figure 2:
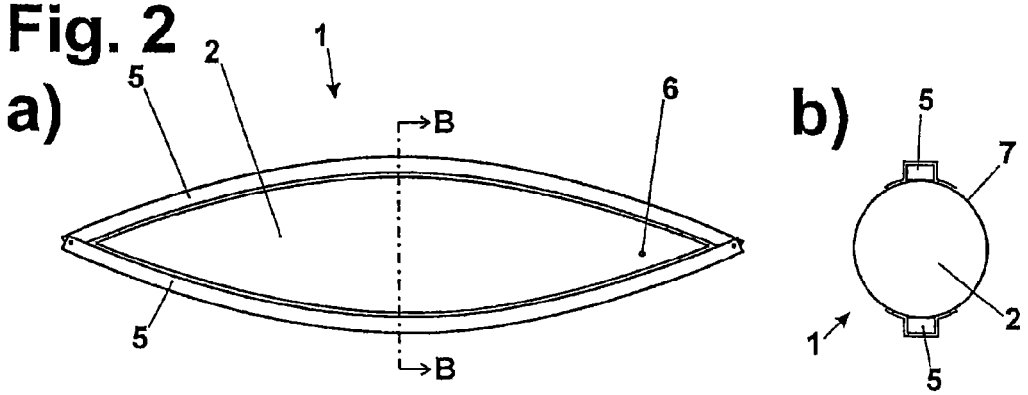
FIGS. 2*a, b*, a schematic side view of and a cross section through a second embodiment of a pneumatic support.

FIG. 2 shows a second embodiment of a pneumatic support 1 that can be used, for example, for roof constructions. At high winds, certain regions of a roof can be subjected to significant wind suction that more than compensates the load in the vertical direction. In a thusly utilized support 1, this results in a reversal of the dynamic effect. In FIG. 2, the sole bottom tension element 4 of FIG. 1 was replaced with a compression/tension element 5; i.e., an element that is able to absorb compressive forces as well as tensile forces. The simplest and most commonly used compression/tension element 5 consists of a second compression bar 3. For example, such a bar can be manufactured of steel or aluminum because these materials have similarly adequate tensile and compressive properties. Materials with adequate compressive but insufficient tensile properties can be prestressed with tension cables such that they can also be used for absorbing tensile forces. One example of a material that is provided with a high tensile strength in this fashion is concrete prestressed with steel cables. In FIG. 2, two compression/tension elements 5 encompass the hollow body 2 along two diametrically opposite surface lines. The compression/tension elements 5 are also fixed to the surface lines in order to prevent buckling of these elements under a load. The compression/tension elements 5 are connected to one another at their ends and serve as tension element or as compression element depending on the direction of the load. The scope of the invention includes embodiments, in which the two compression/tension elements 5 differ with respect to their compressive or tensile properties. For example, the compression/tension elements 5 may be realized such that the upper element is able to withstand higher compressive forces than the lower element. FIG. 2*a* shows a side view, and FIG. 2*b* shows a section along the line BB.

Figure 3:
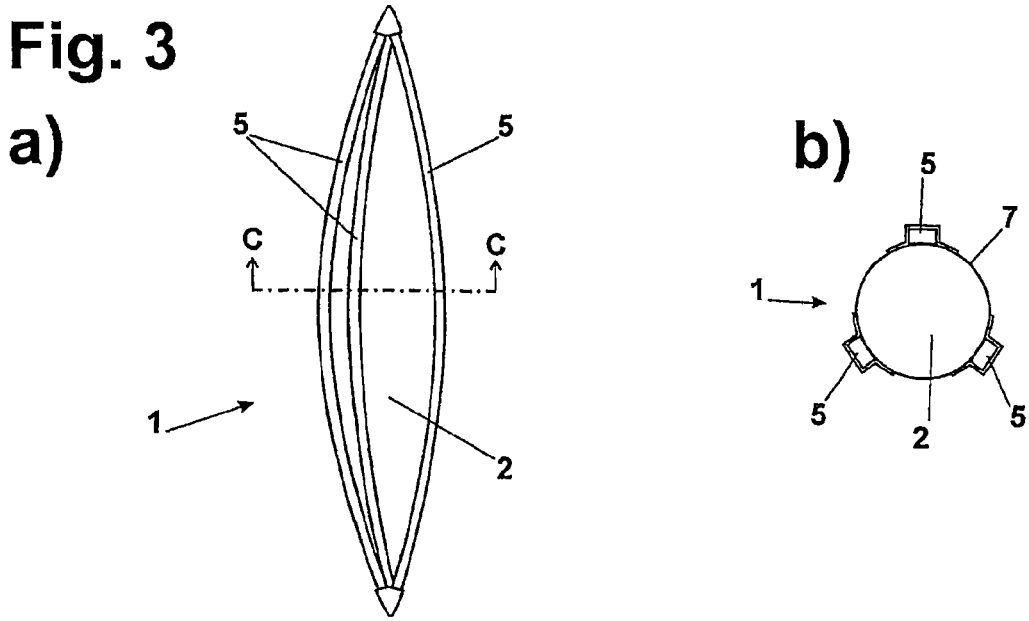
FIGS. 3*a, b*, a schematic side view of and a cross section through a third embodiment of a pneumatic support.

A third embodiment of the object of the invention is illustrated in FIG. 3. In the above-described examples, the supports 1 are essentially subjected to a load in the vertical plane. However, if a support 1 is arranged vertically in an upright position and used as the column, the transversal forces essentially occur no longer in one plane only, but may subject the support to loads of similar intensity from all sides, for example, a wind load. In order to withstand forces from all sides, the support 1 shown in FIG. 3 is provided with three compression/tension elements 5 that are uniformly distributed over the cross section of the hollow body 2 and fixed thereto along surface lines, wherein said compression/tension elements are non-positively connected to one another at their ends. When utilizing such a support 1 as a supporting column, it is also subjected to an axial load. The scope of the invention includes embodiments, in which more than three compression/tension elements 5 are distributed over the hollow body 2. FIG. 3*a* shows an isometric representation, and FIG. 3*b* shows a cross section along the line CC.

Figure 4:
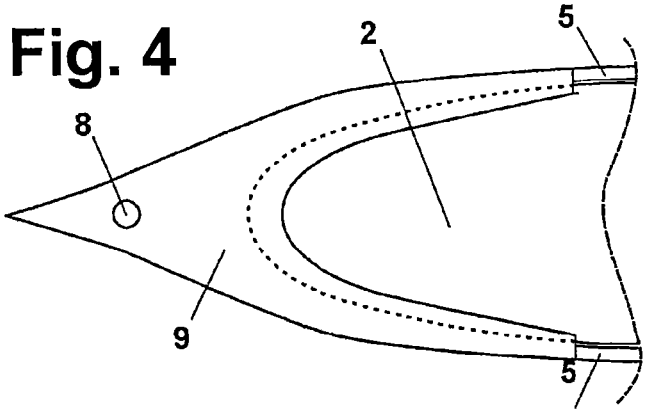
FIG. 4, a schematic side view of a first embodiment of the non-positive connection of the compression/tension elements.
Figure 5:
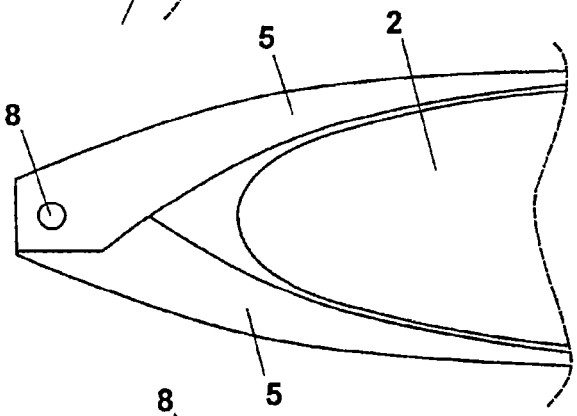
FIG. 5, a schematic side view of a second embodiment of the non-positive connection of the compression/tension elements.

FIGS. 4 and 5 show different options for connecting the compression/tension elements 5 at the ends of the support 1. In FIG. 5, the compression/tension elements 5 are connected to an end piece 9 that may encompass, for example, the end of the hollow body 2. An axle 8 may be fixed, for example, in the end piece 9 in order to incorporate the support into an interconnected construction; alternatively, the end piece 9 could be designed such that it can be directly placed on a bearing.

In FIG. 5, the ends of the compression/tension elements 5 are connected by means of an axle 8.

Figure 6:
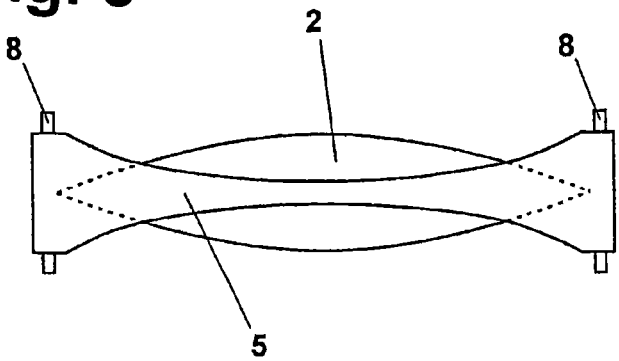
FIG. 6, a schematic top view of one embodiment of a compression/tension element.

FIG. 6 shows an advantageous embodiment of a compression/tension element 5 that has a wider cross-section toward the ends and therefore a superior flexural strength. This construction of the compression/tension element 5 takes into account the fact that the compression/tension elements 5 need to absorb higher bending moments at the ends of the support 1 than in the center of the support 1. In FIG. 5, a greater flexural strength toward the ends of the compression/tension elements 5 is achieved due to this increased cross section.

Figure 7:
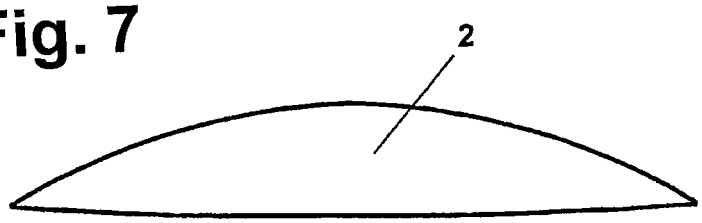
FIGS. 7-9, schematic side views of three exemplary shapes of a hollow body.
Figure 8:
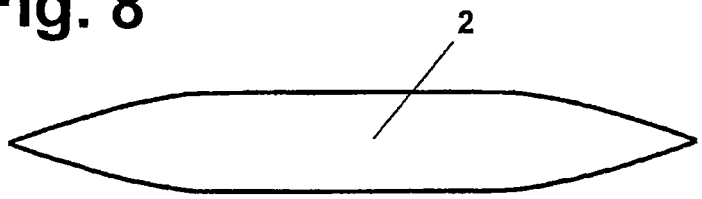
Figure 9:
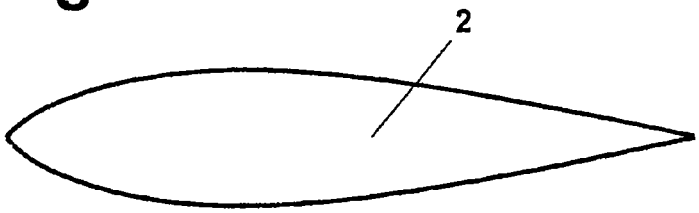

FIGS. 7-9 show different embodiments of the hollow body 2. The cross section of the hollow body 2 is essentially circular over the entire length. However, the scope of the invention also includes embodiments with other cross sections or cross sections that vary over the length of the hollow body, for example, a flattening cross-section in order to achieve a superior lateral stability. FIG. 7 shows an embodiment of an asymmetric hollow body 2 that has a more significant curvature on the upper side of the support 1 and a flatter curvature on the underside. Supports 1 with thusly shaped hollow bodies 2 only deflect slightly when they are used as bridges and subjected to loads from one side. FIG. 7 shows a hollow body 2 that is realized in a rotationally symmetrical fashion referred to the longitudinal axis. This hollow body essentially consists of a cylindrical tube with pointed ends. If viewed in the form of a longitudinal section, the hollow body 2 shown in FIG. 9 is realized in a gutate fashion.

Figure 10:
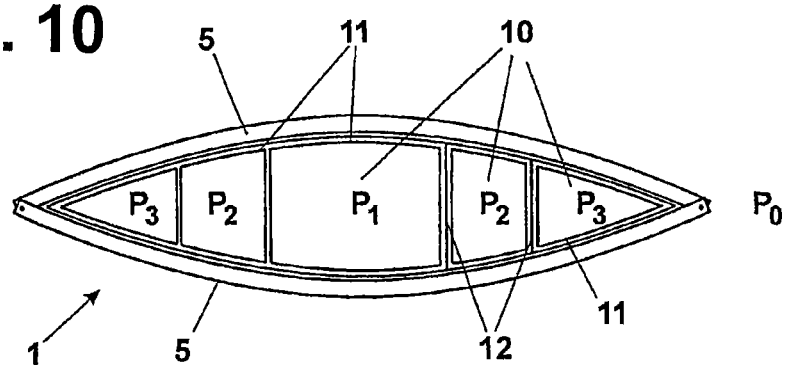
FIGS. 10-12, schematic longitudinal sections through three embodiments of hollow bodies that are divided into several pressure chambers.
Figure 11:
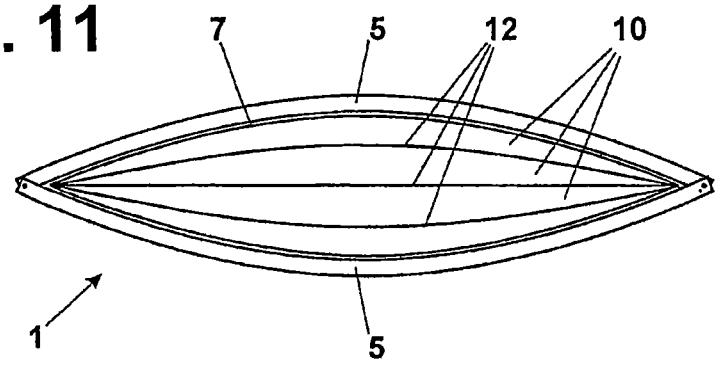
Figure 12:
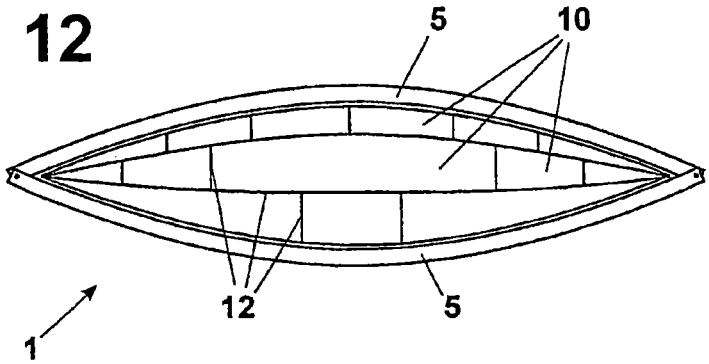

FIGS. 10-12 show different embodiments with hollow bodies that are divided into several chambers 10. In FIG. 10, the hollow body is divided into several chambers 10 that occupy the entire cross section of the hollow body 2 transverse to the longitudinal axis. These chambers 10 can be pressurized to different degrees. The embodiment shown represents a variation with three pressure levels. In this case, the following applies: $P0<P1<P2<P3$. The pressure increases toward the ends of the support 1. In FIG. 11, the hollow body 2 is divided into several chambers 10 that are essentially arranged parallel to the longitudinal direction and extend over essentially the entire length of the hollow body 2. FIG. 12 shows a combination of longitudinally and transversely divided chambers 10. One common aspect of the embodiments shown in FIGS. 10-12 is that the hollow body consists of a flexible cover 7 of limited stretchability, for example, of aramide-reinforced fabric. Several bladders 11 of a stretchable, gas-tight material are inserted into this cover 7 of limited stretchability. In addition, webs 12 embedded into the outer cover 7 may serve for essentially defining the position of the pressurized bladders 11 and thusly prevent the bladders 11 from shifting within the cover 7. This is illustrated in FIG. 10 on one side of the support 1. However, it would also be conceivable and fall under the scope of the invention to divide a gas-tight cover 7 with gas-tight webs 12 into several chambers 10 as shown in FIGS. 11, 12.

Figure 13:
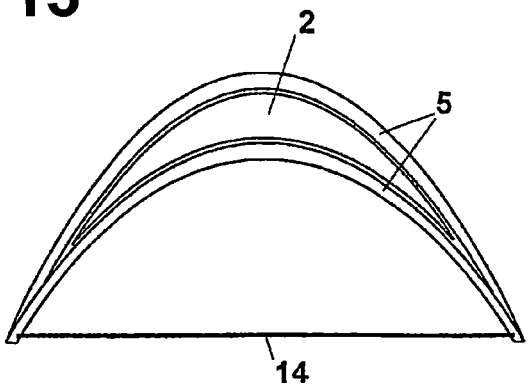
FIG. 13, a schematic side view of a fifth embodiment of a pneumatic support, and FIGS. 14*a-c*, schematic representations of a first application example for the connection of several pneumatic supports.

FIG. 13 shows another embodiment of the object of the invention. A support 1 according to FIG. 2 is curved upward in an arc-shaped fashion and therefore has a concave underside and a convex upper side. The distance between the two ends of the support 1 can essentially be fixed by clamping the ends into abutments or by means of an external tension element 14. When the support 1 is subjected to a downwardly acting load, the two compression/tension elements 5 are compressed while the tensile forces are absorbed by the abutments or the tension element 14.

Figure 14:
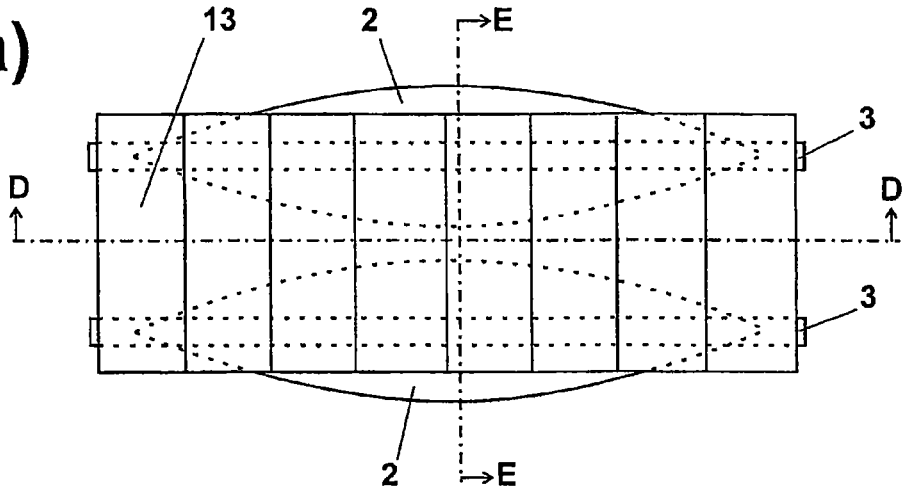
Figure 14:
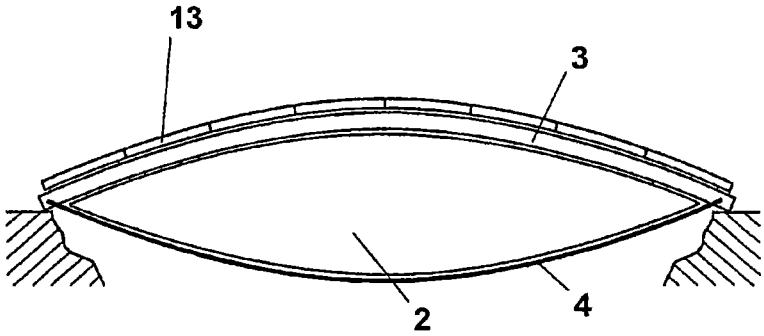
Figure 14:
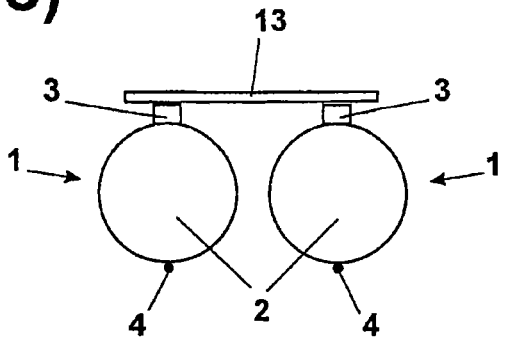

FIGS. 14*a-c* show an application example for pneumatic supports 1 in the construction of a bridge. Two supports 1 according to FIG. 1 are combined into a lightweight bridge by means of a roadway construction 13 that connects the supports and lies on the compression bars 3. Since a person skilled in the art is familiar with different options for manufacturing such a roadway, for example, in the form of a sandwich structure of fiber-reinforced plastics, this aspect is not discussed in detail. FIG. 14*a* shows a top view of the bridge, FIG. 14*b* shows a section along the line DD, and FIG. 14*c* shows a section along the line EE.

What is claimed is:

1. A pneumatic support comprising:

a gas-tight elongated hollow body of a flexible material adapted to be pressurized with compressed gas;

at least one compression bar which, responsive to application of a transverse operational load, is axially compressed;

at least one tension element which, responsive to application of the transverse operational load, is axially tensioned;

wherein the hollow body has a tapered shape toward both of ends of the hollow body;

wherein the at least one compression bar and the at least one tension element are connected to one another at a common node located at respective ends of the hollow body;

wherein, when the hollow body is inflated, the at least one compression bar and the at least one tension element lie on a generator line of the hollow body; and wherein, relative to the application of the transverse operational load, the at least one substantially rigid compression element lies on a near side of the hollow body and the at least one tension element lies on a far side of the hollow body.

2. The pneumatic support according to claim 1, wherein the at least one tension element and the at least one compression bar are arranged around the hollow body in a rotationally symmetrical fashion.

3. The pneumatic support according to claim 1, wherein the at least one compression bar is fixed on the hollow body along a surface line thereof and connected to the at least one tension element at two ends.

4. The pneumatic support according to claim 3, wherein the at least one compression bar extends along a surface line of the hollow body that lies diametrically opposite of the at least one tension element on the hollow body.

5. The pneumatic support according to claim 1, wherein the hollow body comprises an essentially circular cross section along a longitudinal axis.

6. The pneumatic support according to claim 5, wherein the hollow body is divided into a plurality of chambers that can be pressurized transverse to the longitudinal axis, wherein the plurality of chambers extend over the essentially circular cross section of the hollow body.

7. The pneumatic support according to claim 6, wherein the plurality of chambers are pressurized to different degrees and subjected to a higher pressure toward the ends of the hollow body than towards a center of the hollow body.

8. The pneumatic support according to claim 1, wherein the hollow body is divided into a plurality of chambers that can be pressurized and lie parallel to a longitudinal axis, wherein the plurality of chambers extend over a length of the hollow body.

9. The pneumatic support according to claim 1, further comprising end pieces, wherein the at least one compression bar and the at least one tension element are operatively coupled to said end pieces.

10. The pneumatic support according to claim 1, wherein the at least one tension element and the at least one compression bar are fixed on the hollow body via at least one of:

a plurality of bands that extend around the hollow body and are fixed on the at least one tension element and the at least one compression bar;

pockets, wherein the at least one tension element and the at least one compression bar are inserted into said pockets; and welt-type connections.

11. The pneumatic support according to claim 1, wherein the hollow body is composed of:

an outer cover;

at least one inner bladder inserted therein; and wherein the outer cover comprises a flexible material of limited stretchability and the inner bladder comprises an air-tight elastic membrane.

12. The pneumatic support according to claim 11, wherein the outer cover of the hollow body is divided into a plurality of chambers by means of webs.

13. The pneumatic support according to claim 1, wherein the pneumatic support is arc-shaped.

14. The pneumatic support according to claim 1, wherein ends of the pneumatic support are connected by an external tension element that does not adjoin the hollow body.

15. The pneumatic support according to claim 1, wherein the pneumatic support is utilized as support elements in building construction and civil engineering works.

16. The pneumatic support according to claim 1, wherein the pneumatic support is utilized as bridge supports, wherein a roadway construction is placed on an upper side of the at least one compression bar and fixed thereon.

* * * * *